US005655392A

United States Patent [19]

Holmgren

[11] Patent Number: 5,655,392

[45] Date of Patent: Aug. 12, 1997

[54] ANTI-THEFT DEVICE FOR SHOES

[75] Inventor: Bertil Holmgren, Vellinge, Sweden

[73] Assignee: M W Trading APS, Glyngore, Denmark

[21] Appl. No.: 406,967

[22] PCT Filed: Sep. 29, 1993

[86] PCT No.: PCT/SE93/00787

§ 371 Date: Sep. 18, 1995

§ 102(e) Date: Sep. 18, 1995

[87] PCT Pub. No.: WO94/08115

PCT Pub. Date: Apr. 14, 1994

[30] Foreign Application Priority Data

Sep. 29, 1992 [SE] Sweden ..... 9202833

[51] Int. Cl.[6] ..... E05B 73/00

[52] U.S. Cl. ..... 70/57.1; 24/514; 36/136; 36/139; 70/19; 70/58; 70/59; 70/230; 340/572; 340/693

[58] Field of Search ..... 70/57, 57.1, 58, 70/59, 19, 276, 230; 340/572, 551, 693; 36/132, 136, 137, 139, 64, 65; 24/514, 569

[56] References Cited

U.S. PATENT DOCUMENTS

| | | | |
|---|---|---|---|
| 743,606 | 11/1903 | Witte | 70/59 |
| 1,293,109 | 2/1919 | Kaplan | 70/19 |
| 2,325,349 | 7/1943 | Vineberg | 70/19 |
| 4,081,918 | 4/1978 | O'Brien | 36/132 |
| 5,144,820 | 9/1992 | Holmgren | 70/57.1 |
| 5,319,349 | 6/1994 | Smith, III | 340/572 X |
| 5,388,433 | 2/1995 | Andersson et al. | 70/57.1 |

FOREIGN PATENT DOCUMENTS

| | | | |
|---|---|---|---|
| 320088 | 8/1934 | Italy | 36/65 |
| 103274 | 1/1964 | Norway | 24/514 |
| WO90/07046 | 6/1990 | WIPO . | |

*Primary Examiner*—Lloyd A. Gall

*Attorney, Agent, or Firm*—Merchant, Gould, Smith, Edell, Welter & Schmidt, P.A.

[57] ABSTRACT

An anti-theft device to be applied to a shoe and provided with a sensor element (52) of an alarm system comprises two clamp plates (11, 12) which can be tightened against each other by a screw mechanism to be attached to the shoe straddling the edge of the upper leather thereof which defines the insert opening for the foot, and a device for preventing operation of the screw mechanism for displacement of the clamp plates from the tightened position, which can be actuated by means of a special tool only.

6 Claims, 5 Drawing Sheets

ANTI-THEFT DEVICE FOR SHOES

The present invention relates to an anti-theft device to be applied to a shoe and provided with a sensor element of an alarm system.

In shops and department stores shoes are exposed as "half-pairs", which means that one shoe only of a pair of shoes is exposed in order that the customer can examine the shoe and try it on, the other shoe being stored in the corresponding shoe box at a site, usually a separate storage space, where said other shoe is available to the shop attendants only. The purpose of exposing the shoes in this way is of course that the customers shall not be tempted to take a pair of shoes away without paying therefor. However, it is customers' desire that both shoes should be exposed so that they can be tried on without the necessity to turn to a shop attendant, and this is in good agreement with the desire of the salesmen to reduce the storage space and to use the space where the shoes are exposed also as a storage space. However, in the case said lather system is applied the owner of the shop will soon find to his great dismay that a major number of the exposed pairs of shoes have been replaced by used shoes because dishonest persons have taken a pair of new shoes and replaced them by a pair of used shoes.

In order to put an end on this trouble there is accordingly a clear need for an anti-theft device for shoes but, sorry to say, there exists today no such device which is constructed so as to be suitable specifically for this product. Prior art anti-theft devices are generally constructed to be attached in an existing aperture in the product to be protected against theft or, if there is no such aperture cannot be attached without the product being pierced at some place. As far as shoes are concerned it is, however, required that the anti-theft device can be attached to the shoes without damaging the material of the shoe; not even the surface finish of the shoe material should be damaged. Moreover, which is not less important, the anti-theft device should in no way prevent a person from trying the shoe on with the anti-theft device attached to it.

The purpose of the invention is to provide such an anti-theft device, and for this purpose the invention provides an anti-theft device of the kind referred to above with the characterizing features of claim 1.

The presently preferred embodiment of the anti-theft device according to the invention is defined in claim 3.

Figure 1:
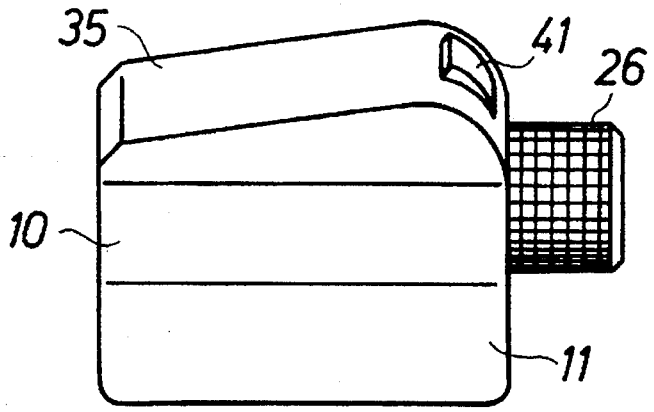
Figure 2:
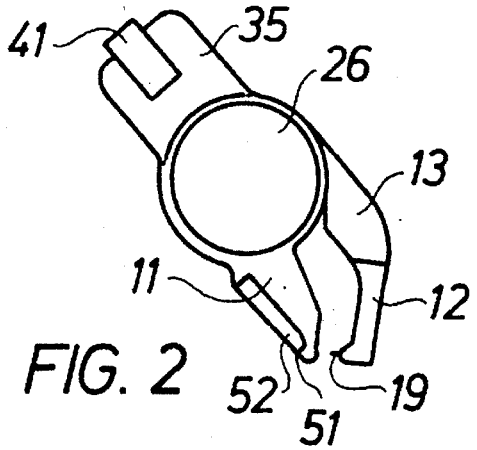
Figure 3:
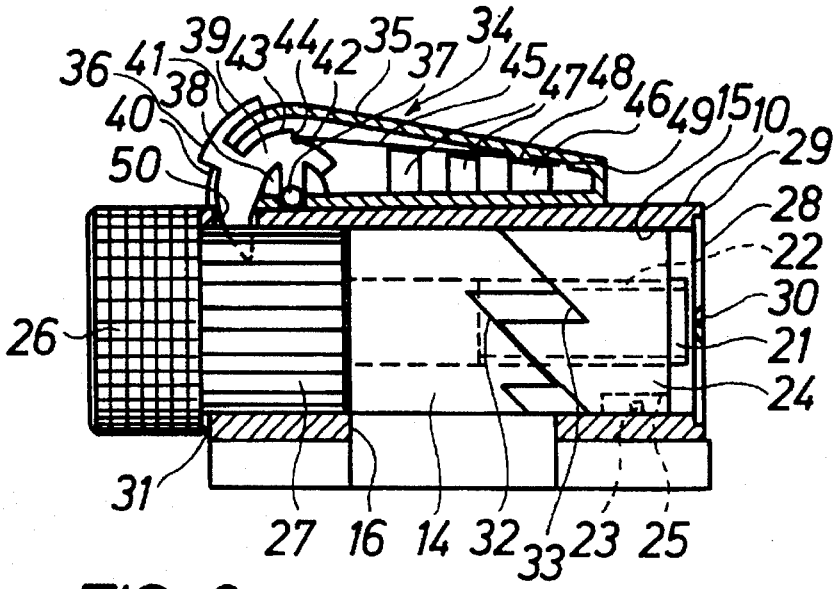

In order to explain the invention in more detail reference is made to the accompanying drawings which disclose two illustrative embodiments and wherein FIG. 1 is a side view of the anti-theft device according to the invention in the first embodiment thereof, FIG. 2 is an end view of the device as seen from the right side in FIG. 1, FIG. 3 is an enlarged axial cross sectional view of the anti-theft device.

Figure 4:
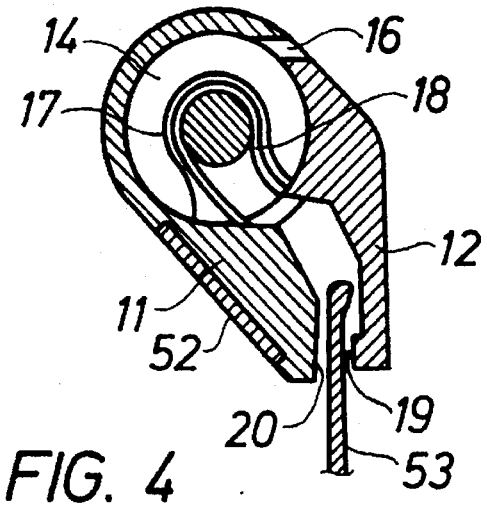
Figure 5:
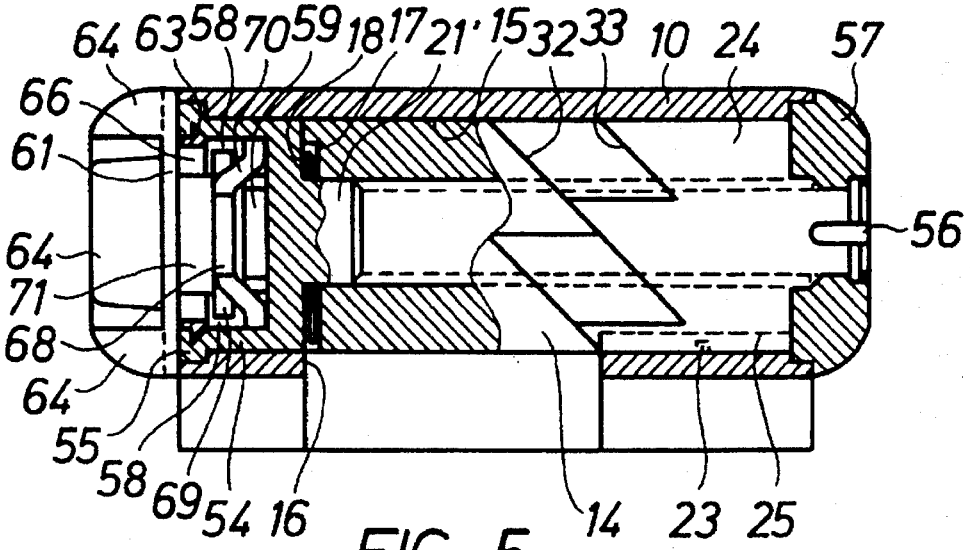
Figure 6:
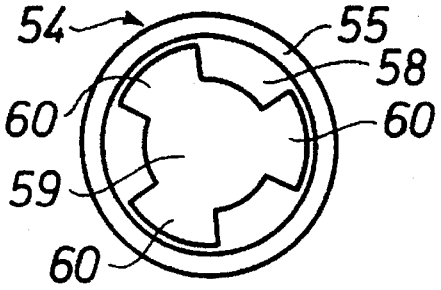
Figure 7:
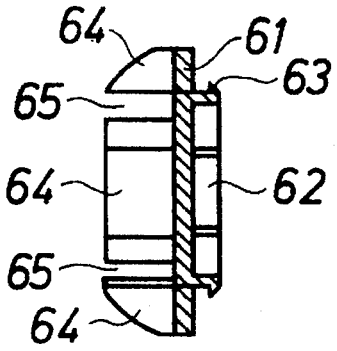
Figure 8:
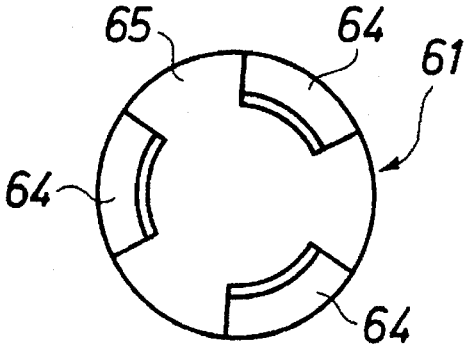
Figure 9:
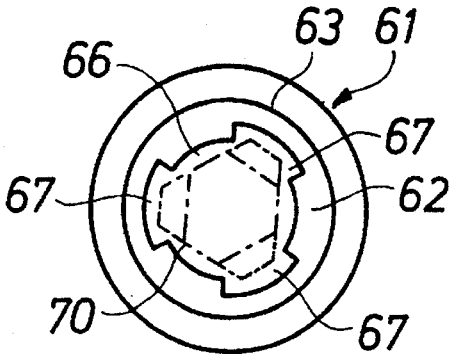
Figure 10:
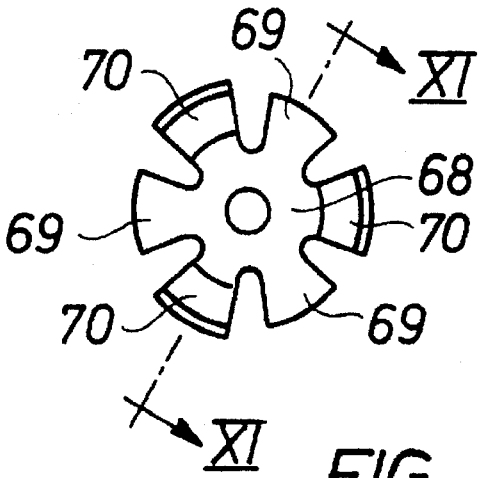
Figure 11:
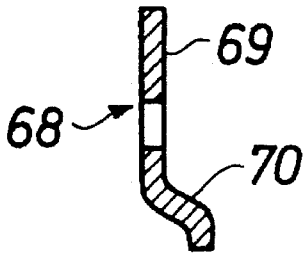
Figure 12:
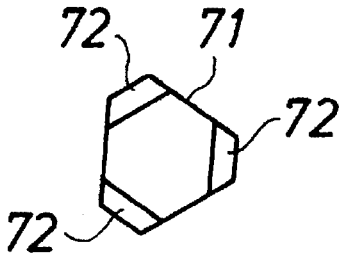
Figure 13:
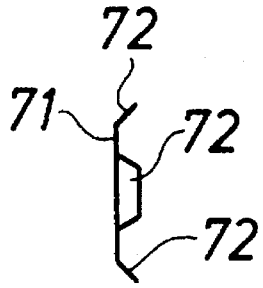
Figure 14:
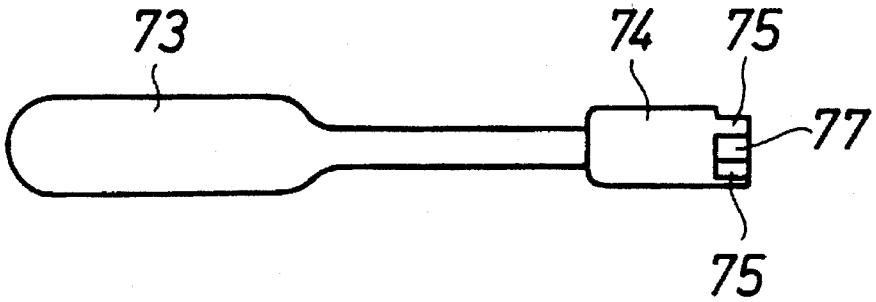

FIG. 4 is a transverse cross sectional view, also enlarged, of the device attached to a shoe, FIG. 5 is an axial cross sectional view of the anti-theft device of the second embodiment, FIG. 6 is an end view of the head of the screw bolt in the embodiment according to FIG. 5, FIG. 7 is an axial cross sectional view of a control member forming part of the embodiment according to FIG. 5, FIG. 8 is an end view of the control member as seen from the left side in FIG. 7, FIG. 9 is an end view of the control member as seen from the right side in FIG. 7, FIG. 10 is a plan view of a washer forming part of the embodiment according to FIG. 5, FIG. 11 is a transverse cross sectional view of the washer in FIG. 10 taken along line XI—XI, FIG. 12 is a plan view of a spring washer forming part of the embodiment according to FIG. 5, FIG. 13 is a side view of the spring washer, FIG. 14 is a reduced side view of a special tool for controlling the anti-theft device according to FIGS. 5–13, and FIG. 15 is an end view of the tool in FIG. 14.

The anti-theft device according to FIGS. 1–4 comprises a cylindrical housing 10 forming a clamp plate 11 integral therewith. A second clamp plate 12 for cooperation with said first mentioned clamp plate is made integral with an arm 13 which is integral with a sleeve 14 said sleeve having a cylindrical outside surface and being rotatably mounted in a cylindrical bore 15 in the housing, arm 13 extending through a slot 16 in the housing wall. In an end recess 17 in sleeve 14 there is provided a hair-pin spring 18 one limb of which engages the recess in the sleeve and the other end of which engages the housing so that clamp plate 12 is spring biased away from clamp plate 11. The clamp plates have the same axial dimension, and on the side of clamp plate 12, facing clamp plate 11, there are a number of short, thin pins 19 or points of another kind which are distributed in the axial direction of the clasp plate and are opposite a flat surface 20 on clamp plate 11.

The pins can be attached individually to clamp plate 12, and this plate as well as clamp plate 11 and housing 10 can consist of a plastic material (Delrin$^{R}$). The pins can be attached for example when the clamp plate is being injection moulded, and usually it may be sufficient that two pins are provided. In that case the manufacture will be simplified if the pine are angled from the ends of the limbs of a U-shaped wire bow the attachment to the plate being effected by inserting the bow in a corresponding groove in the clamp plate and attaching the bow to the plate by ultrasound welding. It is also possible to attach to the clamp plate a metal sheet having teeth of the same type as those provided on a grater. Clamp plate 12 can also consist of a metal, e.g. pressure moulded aluminium, with teeth formed therein. If the upper leather of the shoe is not sensitive also the clamp plate 11 can have pins or teeth of one kind or the other.

A screw bolt 21 extends through sleeve 14 and is rotatable therein, said screw bolt having a threaded end portion 22. A nut 24 which is mounted for axial movement in bore 15 of housing 10 is mounted on said end portion, said nut being cylindrical on the outside thereof and being prevented from rotation in bore 15 by a pin or another projection 23 in the bore as being displaceably received in an axial groove 25 in the cylindrical surface of the nut. The bolt has a head 26 located outside the bore, said head having a knurled cylindrical surface and serving as a knob for rotating the bolt manually. Immediately inwardly of the head the bolt forms a portion 27 which is cylindrical and fills completely the cross sectional area of the bore and the axial distance between head 26 and sleeve 14 and which has alternating axial ribs and grooves. A washer 28 is rotatably mounted in a recess 29 at the end of housing 10 and is attached to the end of the bolt by means of a screw 30 in order that the bolt shall be axially retained in the housing by means of the washer and a shoulder 31 formed by the head.

Sleeve 14 and nut 24 at the ends thereof facing each other have a saw-tooth portion 32 and 33, respectively, and can be engaged with each other at the angled flanks of said portions. When nut 24 is screwed against sleeve 14 by means of bolt 21 the angled flanks are pressed against each other and slide against each other providing a rotative force between nut and sleeve. Since the nut cannot rotate due to the guiding means 23, 25 such rotative force will cause rotation of sleeve 14 against the bias of spring 18 in clockwise direction as seen in FIG. 4, which means that clamp plate 12 will be moved towards clamp plate 11. When nut 24 is screwed in the opposite direction clamp plate 12 will be moved away from clamp plate 11 under the bias of spring 18.

In order to lock the bolt against rotation thereof there is provided a lock mechanism 34 of the kind shown and described in SE-B-461 121. The lock mechanism comprises a lock housing 35 consisting of the same plastics material as housing 10 and connected to said housing by ultrasound welding or in another manner which provides a homogenous connection between the two housings. Lock housing 35 can have a bottom as shown in FIG. 3 but the bottom thereof can also be formed by housing 10. A rotary belt 36 is rotatable mounted at pins 37 in two slotted lugs 38 mutually spaced in the transverse direction of housing 10. The rotary belt can consist of fibre-reinforced hard plastics material or of pressure moulded aluminium so that it is difficult to damage or break the rotary bolt. On a stern 39 which projects from the rotary bolt through a slot 40 in lock housing 35 a finger grip 41 is provided said finger grip being available outside the lock housing. Moreover, two circular curved edge surfaces 42 and 43 are formed by the rotary bolt, said surfaces having the center thereof on the axis of the pins. One edge surface 42 has a smaller radius than the other one 43 so that there is provided between the surfaces a shoulder 44. A spring blade 45 of a material which can be attracted magnetically is clamped at one end thereof against a support 46 and is biased such that the spring blade at the other free end thereof is kept engaged with the rotary bolt. There are also provided two spring blade supports 47 located between the ends of the spring blade said supports preventing bending of the spring blade inwardly when the spring blade is exposed to pressure. In order to further fix the position of spring blade 45 there is provided on lock housing 35 a projection 48 engaging an aperture in the spring blade in the area of support 46 and, moreover, the spring blade is supported at a shoulder 49 on the inside surface of lock housing 35.

The position of the lock mechanism shown in FIG. 3 is the engaged position of the lock mechanism wherein the free end of spring blade 45 engages surface 42 and is located immediately in front of shoulder 44, which means that the spring blade in this position prevents the rotary bolt from being rotated from the engaged position thereof at finger grip 41, the rotary bolt in said position projecting radially through an aperture 50 into bore 15 and engaging a groove between two ribs of portion 27. The rotary bolt prevents rotation of the screw bolt and thus pivoting of clamp plate 12.

In order that the rotary bolt can be rotated clockwise to the disengaged position in which the rotary bolt is withdrawn from bore 15 and thus is disengaged from portion 27, spring blade 45 must be displaced from shoulder 44, and this is done by attracting the spring blade to a strong magnet which is advanced towards the lock housing from the outside thereof. The spring blade should be so stiff that in the latching position thereof it cannot be bent away when the rotary bolt is operated manually at finger grip 41, and that a very strong electric magnet or a permanent magnet of high-quality magnet material is required in order to bring the spring blade to the disengaged position. In this position the shoulder 44 of the rotary belt can be rotated past the free end of the spring blade clockwise as seen in FIG. 3 to the disengaged position by the rosary belt being operated manually at the finger grip 41, the rotary bolt being withdrawn from portion 27 so that bolt 21 then is free to rotate.

Means can be provided for arresting the rotary bolt in the disengaged position so that handling of the anti-theft device is facilitated. It is also possible to exclude finger grip 41 and to effect the manual operation of the rotary bolt by means of a pin or the like inserted through slot 40 to be received by a depression or a hole in the rotary belt when this bolt is to be operated manually.

It should also be mentioned that the lock mechanism could be replaced by a lock mechanism of another type than that shown and described herein. However, said latter lock mechanism has been found to be particularly well suited for the anti-theft device according to the invention because it can be given small dimensions and, moreover, has been found to be very safe against unauthorized manipulation.

In clamp plate 11 there is a groove 51 for mounting a sensor 52 constructed as a so called dipole for influencing an electric alarm system. Instead of this arrangement clamp plate 11 can be made considerably larger to form a smooth surface on which a sensor of the type comprising a foil, label, plate or the like can be attached. Sensors of different types are known per se and the purpose thereof is to disturb an electrostatic or magnetic field between two frames defining a passage at the exit of the shop or department store when they are being carried through said field, alarm means then being put into operation via electronic circuits.

When the anti-theft device described is applied to a shoe the lock mechanism should be in the disengaged position, rotary bolt 36 being withdrawn from bore 15, and clamp plate 12 should have been screwed sufficiently far away from clamp plate 11 by means of the bolt in order that the upper leather of a shoe, partly shown at 53 in FIG. 4, can be inserted between the clamp plates, clamp plate 12 being located on the inside of the upper leather, so that the anti-theft device straddles the edge of the upper leather, defining the opening for insertion of the foot into the shoe. Now, the bolt is rotated to press the clamp plates against each other, pins 19 penetrating into the upper leather on the inside thereof without piercing said leather. The anti-theft device is now fixedly attached to the upper leather, and in order to secure the anti-theft device against unauthorized removal the lock mechanism has to be adjusted to the locking position thereof. Then, it may be necessary to rotate the bolt slightly in one direction or the other if one of the ribs of portion 27 in the existing rotational position prevents insertion of the rotary belt into one of the grooves between the ribs. As soon as the rotary bolt has been brought to the locking position it cannot again be brought to the disengaged position without the lock mechanism being actuated by the magnet. The anti-theft device is safely attached to the shoe and cannot be withdrawn therefrom but it prevents in no way that the shoe is tried on in the usual way.

Pins 19 provide a very safe attachment of the anti-theft device but it is also possible to provide an attachment which secures practically the same safety if the two clamp plates on the sides thereof which are facing each other are covered by a rubber material causing great friction, or if an eccentric-clamp roller is provided in one of the clamp plates.

Lock mechanism 34 provides a quite satisfactory safety against unauthorized demounting of the anti-theft device if the elements thereof, particularly the rotary bolt 36, are made of a material having high strength but there may nevertheless be some risk that a strong person by a sturdy grip on head 26 exerts on screw bolt 21 such a great torsional force that the rotary bolt will be broken and the anti-theft device then can be opened. In order to eliminate this risk and at the same time provide an anti-theft device which is of a simpler construction the embodiment according to FIGS. 5–13 has been developed. This is the presently preferred embodiment of the invention.

The embodiment according to FIGS. 5–13 in the same way as the embodiment already described comprises a housing 10, FIG. 5, which is integral with a clamp plate (not shown), a screw bolt 21' of modified construction rotatably mounted in the housing, a nut 24 axially displaceable in the housing, said nut being non-rotatably guided for axial displacement by means of a projection engaging a groove 25 in the nut, and being threadedly engaged with the bolt, and a sleeve 14 rotatably mounted on the bolt and made integral with a movable clamp plate (not shown). The sleeve and the nut have mutually cooperating saw-tooth portions 32 and 33, respectively, for rotation of the sleeve and thus pivoting of the pivoted clamp plate by the nut being screwed axially on the bolt. A sensor (not shown) is provided as previously described. The pivoted clamp plate is sprang biased by means of a hair-pin spring 18 inserted into a recess 17 in one end surface of the sleeve in the manner described in connection with the first embodiment.

The head 54 of bolt 21' is cylindrical and has the same outside diameter as sleeve 14 and nut 24. It covers recess 17 and has an outside flange 55 which is rotatably received in a corresponding enlargement of bore 15. In the opposite end bolt 21' forms a slot 56, and a cover 57 fitting into housing 10 is snapped into the bolt under elastic yielding of the slotted portion thereof. The head forms a cylindrical cavity 58 in the bottom of which there is provided a circular recess 59 having three symmetrically distributed sector-shaped enlargements 60 (FIG. 6). A control member 61 for the screw mechanism is shaped as a washer which at one side thereof has a flange 62 with a hook-shaped outside bead 63 and at the other side thereof has three symmetrically distributed projections 64 separated by spaces 65 (FIG. 8). The control member is inserted at flange 62 into recess 58 under elastic compression of flange 62 which at bead 63 has snapped into a corresponding groove on the inside of recess 58 so that the control member is maintained on the bolt head to cover recess 58 but is rotatable in relation to the bolt. Flange 62 defines a circular space 66 having three symmetrically distributed sector-shaped enlargements 67 (FIG. 9).

A washer 68 (FIGS. 10 and 11) of a metal that can be magnetized forms six sector-shaped flaps every second flap thereof being designated 69 and the intervening flaps being designated 70. Flaps 69 are separated in the plane of the washer while flaps 70 are bent out of this plane as shown in FIG. 11. The washer is disposed in recess 60 in head 54 of bolt 21' with flaps 70 located in enlargements 60 engaging the bottom thereof, the washer being maintained in this position by a spring washer (FIGS. 12 and 13) which has substantially the shape of a regular triangle with cut off corners. The corners are angled to form support feet 72. Spring washer 71 is disposed in recess 66 defined by flange 62 with feet 72 resting against the bottom of the recess (cf. FIG. 9) in enlargements 67. The flat side of the spring washer engages washer 68 and keeps it in position with flaps 70 engaging the bottom of recess 59 in enlargements 60. Then flaps 69 are received by cavity 58 in head 54 outside the recess 66 defined by flange 62. This means that control member 61 with washer 68 in the position described can be freely rotated in relation to head 54, spring washer 71 being rotated in relation to washer 68 which is engaged by the spring washer. The control member thus is disengaged from the screw device which accordingly cannot be actuated with washer 68 in the position shown.

Washer 68 forms a coupling member which, if a magnet is moved against the outside of the control member, can be attracted to the magnet so as to be moved against the inside of the control member against the bias of spring washer 71. It is necessary that the spring washer is sufficiently stiff to allow washer 68 then to be moved into recess 66 defined by flange 62 so fax only that flaps 69 on the washer can be displaced only partly into enlargements 67 formed by recess 66 while flaps 70 are still disposed in enlargements 60 of recess 59 but are lifted from the bottom of said recess and thus are received only partly in said enlargements. When washer 68 is brought to this position it couples control member 61 positively to bolt 21' by flaps 69 being non-rotatably received in recess 66 and flaps 70 being non-rotatably received in recess 59 (possibly it may be necessary to rotate the control member in relation to the bolt initially to a small extent before flaps 69 snap into enlargements 67). When the coupling member formed by washer 68 is engaged the pivoted clamp plate dan be swung by means of control member 61 over the screw mechanism to be moved towards or away from the other clamp plate in the manner described in connection with the embodiment according to FIGS. 1–4.

Figure 15:
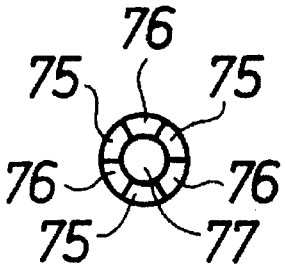

The screw mechanism is actuated by using the tool in FIGS. 14 and 15. On a shaft 73 there is provided a socket 74 forming three symmetrically distributed projections 75 with spaces 76 therebetween. The projections and the spaces are dimensioned such that they can be brought into engagement with spaces 65 and projections 64, respectively, on control member 61. Centrally and inwardly of projections 75 a strong cylindrical permanent magnet 77 is provided which, when the tool is engaged with the control member, will attract washer 68 in order that said washer against the bias of the sprang washer 71 will be engaged also with the control member and will connect said member with the screw mechanism. Once the tool has been engaged with the control member it can thus be used to screw the clamp plates together or apart when the anti-theft device is to be applied according to FIG. 4 or is to be removed, respectively. Without the tool the screw mechanism cannot be actutated because the control member is freely rotatable in relation to the belt. In this case the risk of the anti-theft device being removed by rotating the control member without the washer 68 at the same time being actuated magnetically is completely removed irrespective of the torsional force exerted on the control member.

The anti-theft device according to the invention has been developed particularly for use on shoes in order to solve the problems accounted for above in connection with the exposure of shoes in department stores and shops but it would easily be understood that the anti-theft device according to the invention can be used in connection with other sensible products which have no apertures for the insertion of conventional anti-theft devices and which do not allow penetration of the material the product is made of. The anti-theft device according to the invention for this reason shall not be considered as limited to the use in connection with shoes nor to the illustrative embodiments described herein as other embodiments could be proposed by the skilled man without departing from the concept of the invention. For example, the screw mechanism disclosed herein can be replaced by a screw mechanism of another type for converting a rotational movement to a pivotal or displacement movement of the movable clamp plate. It is also conceivable to use the screw mechanism with magnet coupling shown in FIGS. 5–13 in other devices than anti-theft devices wherein actuation shall be possible only by using a special tool. Furthermore, the anti-theft device can be provided with suspension means such as a loop, a bow, or a hook so that the product associated with the anti-theft device can be suspended for exposure.

Application of the anti-theft device on the edge of the opening for insertion of the foot into the shoe also includes application on the edge of the portion where the lace apertures are provided on a laced shoe.

I claim:

1. Anti-theft device to be applied to a shoe, comprising a sensor element (52) of an alarm system, a first clamp plate (11) and a second clamp plate (12), a screw mechanism (21, 24) operatively connected to said clamp plates for tightening said plates against opposite sides of the upper leather of the shoe with said device straddling the edge of the upper leather, defining the insert opening for the user's foot, and means (36) preventing operation of the screw mechanism for displacement of the clamp plates from the tightened position, which can be actuated by means of a special tool only, characterized by a housing (10) receiving the screw mechanism including a screw bolt (21, 21') and a nut (24) threadingly engaging the screw bolt, said nut being non-rotatably guided in the housing to be axially displaced by rotation of the screw bolt, said first clamp plate being fixedly connected with said housing to be located together with the housing on the outside of the upper leather, and a sleeve (14) on said second clamp plate, mounting said second clamp plate to be located on the inside of the upper leather, for pivotal movement towards and away from said first clamp plate about an axis of said screw bolt.

2. Anti-theft device according to claim 1, characterized in that said sleeve and said nut have saw-tooth portions at their ends facing each other in order that the sleeve guided by the flanks of the saw-tooth portions shall be rotated by axial movement of the nut effected by the screw bolt.

3. Anti-theft device according to claim 1, characterized in that said means for preventing operation of the screw mechanism comprises a lock member (36) for positive engagement with the screw mechanism to prevent operation of the screw mechanism in an engaged position thereof, said lock member being latched in the engaged position and being actuated for movement to a disengaged position by means of the special tool only.

4. Anti-theft device according to claim 1, characterized in that said means for preventing operation of the screw mechanism comprises a normally disengaged coupling (68) between the screw mechanism and a rotatable control member (61) for the screw mechanism, and that said coupling can be engaged to operatively connect the control member with the screw mechanism by means of the special tool only which is constructed for rotating the control member.

5. Anti-theft device according to claim 1, characterized in that said second clamp plate (12) is spring biased for movement from said first clamp plate.

6. Anti-theft device according to claim 1, characterized in that at last one clamp plate (12) has points (19) directed towards the other clamp plate (11).

* * * * *

UNITED STATES PATENT AND TRADEMARK OFFICE

CERTIFICATE OF CORRECTION

PATENT NO. : 5,655,392

DATED : AUGUST 12, 1997

INVENTOR(S) : HOLMGREN

It is certified that error appears in the above-identified patent and that said Letters Patent is hereby corrected as shown below:

At column 2, line 35, change "pine" to —pins—.

At column 3, line 66, change "belt" to —bolt—.

At column 4, line 1, change "rosary belt" to —rotary bolt—.

At column 4, line 48, change "belt" to —bolt—.

At column 5, line 20, change "sprang" to —spring—.

At column 6, line 9, change "fax" to —far—.

At column 6, line 21, change "dan" to —can—.

At column 6, line 43, change "belt" to —bolt—.

Signed and Sealed this

Twelfth Day of January, 1999

*Attest:*

*Attesting Officer*

*Acting Commissioner of Patents and Trademarks*